United States Patent [19]

Gibson

[11] Patent Number: 4,674,160

[45] Date of Patent: Jun. 23, 1987

[54] POWER SQUAT, MULTI-LIFTING WEIGHT APPARATUS

[76] Inventor: Russell K. Gibson, 7504 Winesap Way, Louisville, Ky. 40228

[21] Appl. No.: 765,096

[22] Filed: Aug. 13, 1985

[51] Int. Cl.[4] ..... A63B 21/00

[52] U.S. Cl. ..... 272/134; 272/117; 272/143

[58] Field of Search ..... 272/117, 116, 93, 119, 272/134, 120, 70, 143

[56] References Cited

U.S. PATENT DOCUMENTS

| | | | |
|---|---|---|---|
| 108,401 | 10/1870 | Smith | 272/117 |
| 126,796 | 5/1872 | Forward | 272/117 |
| 167,137 | 8/1875 | Tiebout | 272/117 |
| 169,002 | 10/1875 | Johnson | 272/117 |
| 190,150 | 5/1877 | Lozier | 272/117 |
| 3,751,031 | 8/1973 | Yamauchi | 272/119 |
| 3,797,483 | 3/1974 | Feldman | 128/75 |
| 4,200,282 | 4/1980 | Agyagos | 272/146 |
| 4,270,749 | 6/1981 | Hebern | 272/146 X |
| 4,344,619 | 8/1982 | Szabo | 272/117 |
| 4,589,658 | 5/1986 | Gibson | 272/117 |

FOREIGN PATENT DOCUMENTS

| | | | |
|---|---|---|---|
| 1328412 | 4/1963 | France | 272/70 |
| 24506 | of 1908 | United Kingdom | 272/143 |

*Primary Examiner*—Richard J. Apley
*Assistant Examiner*—J. Welsh
*Attorney, Agent, or Firm*—Richard L. Caslin

[57] ABSTRACT

A multi-lifting weight apparatus is shown to enable the user to perform power squat lifts to develop leg strength throughout the hips, thighs and calf leg muscles, while at the same time eliminating back injuries to the user. The user is provided with a waist harness having a heavily padded belt furnished with both front and rear straps suspended from the belt down between the legs of the user. The lower ends of the straps are joined by a connector that supports a tension member that carries a roller assembly. This apparatus includes an elevated rack with a three-sided hand rail and a pair of platforms separated by a well section. The user stands on the platforms straddling the well section. Steps are formed at one end of the platforms serving as an entrance at the rear for mounting and dismounting the platforms. The front of the rack has a structural extension providing a raised horizontal pivot or fulcrum for an elongated lever that operates in a vertical plane that includes the well section. A pivoted lever arm is located under the elongated lever for supporting various weights at the front of the rack. A tension member restrains the pivoted lever arm to create a negative mechanical advantage as the elongated lever is raised. The roller assembly of the waist harness engages under the elongated lever beneath the standing position of the user and is capable of free movement therealong. Exercises other than power squats can also be performed when using this apparatus.

4 Claims, 5 Drawing Figures

POWER SQUAT, MULTI-LIFTING WEIGHT APPARATUS

BACKGROUND OF THE INVENTION

1. Field of the Invention

This invention relates to the art of weight lifting apparatus, and particularly, for use in building leg strength, while at the same time eliminating back injuries to the user. This weight lifting apparatus includes an elevated rack and a padded waist harness worn by the user that exerts no load on the user's upper body while the user is performing power squats.

2. Description of the Prior Art

An early patent was granted to Butler U.S. Pat. No. 87,465 and it employs an elevated table for supporting the user, and the weights are suspended beneath the table and off of the floor. The weights are mounted on a threaded rod that extends up through an opening in the table, and the upper end of the rod is provided with a pair of shoulder straps which fit over the upper body of the user, but this apparatus is not for use in doing power squats as is the present invention. The elevated table includes a pair of vertical side handles which extend through the table and are joined to the threaded rod that supports the weights.

The Thomas U.S. Pat. No. 882,181 describes exercising apparatus for use when the person is standing on a pair of spaced blocks. The user has outfitted himself with a tapered belt that diverges slightly in a downward direction so as to conform to the contour of the hips. This belt is provided with a pair of crisscrossed shoulder straps. The belt is provided at both the front and rear with hooks that engage the upper ends of cords or chains that are suspended down between the legs of the user and the lower ends of these chains are joined together at a point that connects to the end of a vertical chain on which is suspended a spring mechanism with a recording dial and pointer to indicate the amount of tensile power exerted on the spring mechanism within. The lower end of this exercising device is provided with a hook that is fastened into the floor. When the user is standing on the floor no stress is exerted upon the exercising device. When the user steps onto the blocks this causes the spring mechanism of the exercising device to be placed under tension, and the user operates the apparatus by bending his knees and hips, but this apparatus is not for use in performing power squats.

The Yamauchi U.S. Pat. No. 3,751,031 describes a weighted belt type exercising device that includes a standard weight belt which is fitted with an enlarged loop that can be threaded onto the belt until it reaches the rear portion. This loop is fitted with a connecting ring that supports a link chain for use with a metal hook which is threaded into a plurality of weights. A cushioning means is installed around the outside of the weights so that ankles and feet of the user may be protected from injury when the weights swing forward and rearward or from side to side.

The Smith U.S. Pat. No. 3,911,907 describes a planetary exercising machine which includes an oscillatory turntable that is motor driven and supports on its top surface individual leg exercising foot rest platforms on which the user stands while grasping a hand rail for stability and safety. This machine is useful in rehabilitating stroke or other paralytic victims. The foot supporting platforms oscillate in unison relative to the turntable while the turntable is oscillated relative to the base.

OBJECTS OF THE PRESENT INVENTION

The principal object of the present invention is to provide a multi-lifting weight apparatus for use in performing power squat lifts by the use of a elevated rack having a pair of spaced platforms separated by a well section in combination with a heavily padded waist harness worn by the user and supporting a roller assembly at its lower end for engaging a weighted elongated lever that moves in a vertical plane extending through the well section.

A further object of the present invention is to provide a multi-lifting weight apparatus of the class described where the elevated rack has a structural extension at its front end for providing a raised pivot for connection to the elongated lever, and where the weights are supported on a pivoted lever arm that is mounted intermediate the elongated lever and below this lever to create a negative mechanical advantage as the elongated lever is being raised.

A further object of the present invention is to provide a weight apparatus of the class described where the elevated rack is provided with a handrail extending around three sides of the rack, where the front rail projects beyond the front of the platform, and the opposite side rails project rearwardly from the platform for increasing the intended uses of the apparatus.

SUMMARY OF THE INVENTION

The present invention provides weight lifting apparatus for use by a person in performing power squat lifts for strengthening the leg muscles while eliminating back injuries to the user. This apparatus has an elevated rack with a pair of spaced platforms separated by a well section. The front of the rack has a structural extension that includes a spaced supporting column with a raised horizontal pivot to which is attached an elongated lever that extends generally downwardly at an inclined angle and pivots within a vertical plane that includes the well section. Weights are hung under the elongated lever and located within the structural extension. The user is furnished with a waist harness having a heavy belt with interior padding. The belt has both front and rear straps that are joined at the bottom by a connector that supports a roller means that is adapted to engage under the elongated lever for riding therealong.

BRIEF DESCRIPTION OF THE DRAWINGS

This invention will be better understood from the following description taken in conjunction with the accompanying drawings, and its scope will be pointed out in the appended Claims.

DETAILED DESCRIPTION OF THE DRAWINGS

This invention will be better understood from the following description taken in conjunction with the accompanying drawings, and its scope will be pointed out in the appended Claims.

Figure 1:
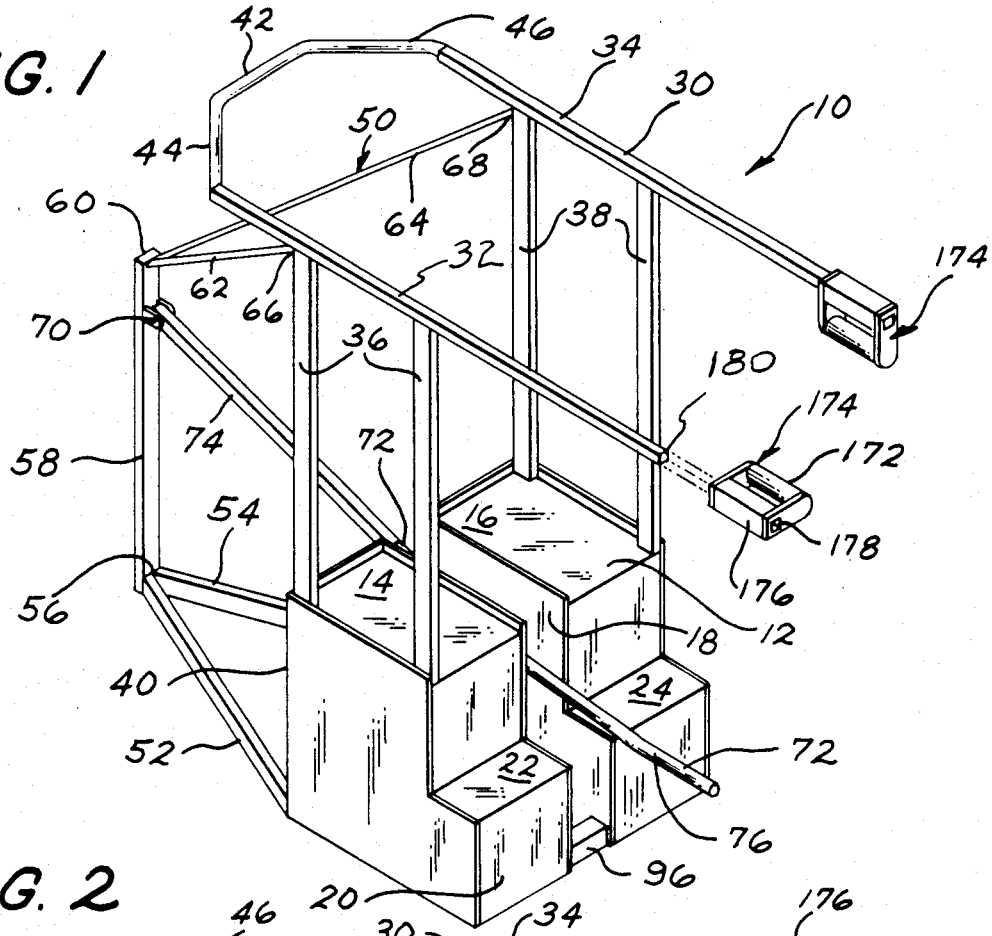
FIG. 1 is a top perspective view taken from the left rear side of the weight lifting apparatus embodying the present invention.

FIG. 1 is a top perspective view from the left side of the weight lifting apparatus 10 embodying the present invention. This apparatus employs a unitary elevated rack 12 having a pair of raised platforms 14 and 16 that are separated by a well section 18. This elevated rack 12 has a rear entrance end 20 that is furnished with steps 22 and 24 which make it possible for the user to mount and dismount the rack with little effort.

The elevated rack 12 is furnished with a handrailing 30 that extends around three sides of the rack except for the rear entrance end 20. The handrailing 30 has two parallel side sections 32 and 34 which are supported from vertical corner posts 36 and 38 respectively. The front end 40 of the elevated rack 12 has the handrailing 30 extending forwardly of the rack, as best seen in FIG. 1, and this forward section 42 of the handrailing has two tapered corner sections 44 and 46 which are easy to grasp by the hands of the user standing on the two platforms 14 and 16 when doing power squat lifts.

The front end 40 of the elevated rack also has a structural extension 50 which comprises two inclined floor braces 52 and 54, as best seen in FIG. 1, which are fastened together at 56 for supporting a vertical column 58. The top end 60 of the vertical column 58 is reinforced by two inclined struts 62 and 64 which are each connected to the top end 66 and 68 of the vertical corner posts 36 and 38 respectively. The whole purpose of this structural extension 50 is to provide a pivot means or a fulcrum 70 near the top of the vertical column 58 for cooperation with an elongated lever 72 that extends generally downwardly at an inclined angle through the well section 18 of the elevated rack and is capable of moving in a vertical plane that extends through this well section between the two raised platforms 14 and 16, as best seen in FIG. 1. Actually the elongated lever 72 is formed from two pieces which are welded together. The front section 74 of the lever 72 is preferably a solid bar of generally square transverse cross-section and its free end is joined to the pivot means 70 by a suitable bolt. The rear section 76 of the lever 72 is also a solid bar of generally circular transverse cross-section for cooperation with a double-flanged roller 78, as best seen in FIGS. 2 and 5 herein.

Figure 2:
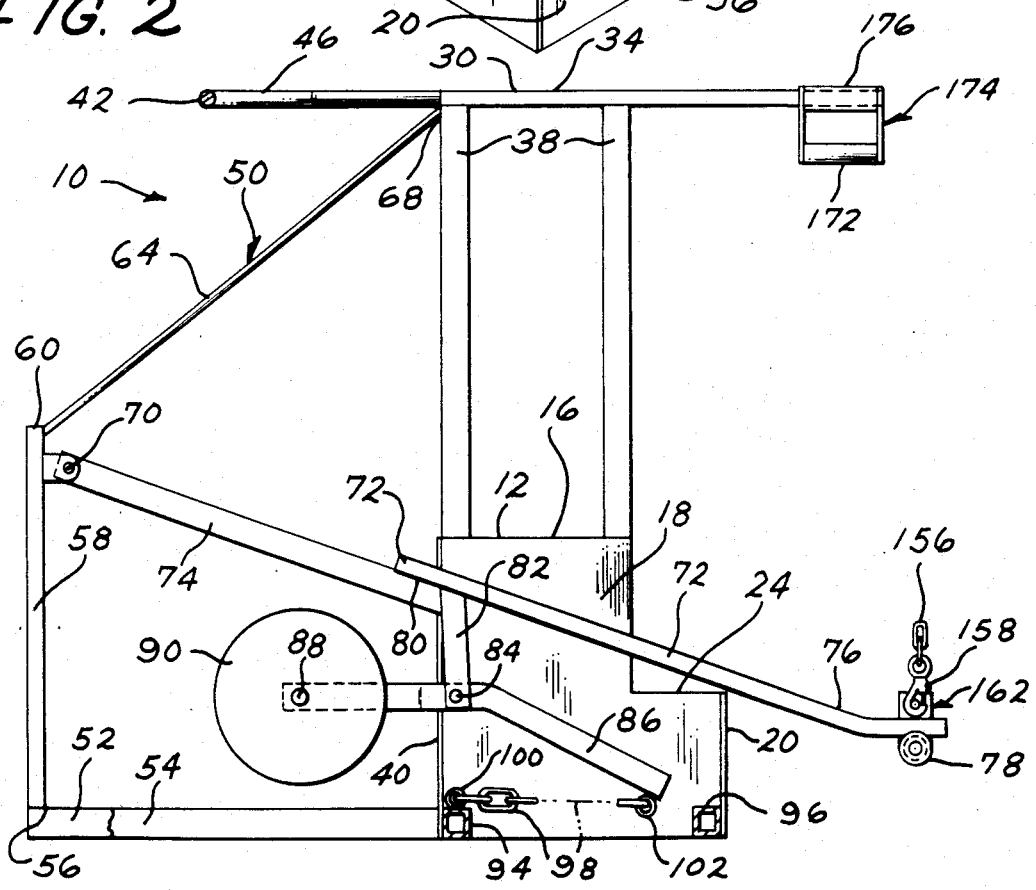
FIG. 2 is a cross-sectional side elevational view generally through the center of the apparatus of FIG. 1 to best show the nature of the pivoted elongated lever that extends through the well section of the apparatus and carries the heavy weights that are to be lifted by the user.

Notice in FIG. 2 that the front and rear sections 74 and 76 of the elongated pivoted lever 72 are overlapped near the center of the lever as at 80 so that they may be welded together and function as a single lever 72. A downwardly directed bracket 82 extends from this midportion of the pivoted lever 72, and it carries a pivot pin 84 supporting a pivoted lever arm 86 near the center thereof. The front portion of this pivoted lever arm 86 extends forwardly of the front end 40 of the elevated rack 12. The rear portion of this pivoted lever arm 86 is positioned within the well section 18 of the rack. The front end of this pivoted lever arm carries a transverse shaft 88 that extends to the opposite sides of this lever arm for carrying the weighted disks 90 of the type that are used with barbells for exercise and weight lifting. Attention is directed to FIG. 4 which is a fragmentary transverse cross-sectional elevational view taken on the line 4—4 of FIG. 3 looking toward the rear of the apparatus and showing the two weighted disks 90 supported on the shaft 88 at the opposite sides of the front portion of the pivoted lever arm 86.

Looking at FIGS. 1 and 2, the well section 18 includes two cross braces 94 and 96 located at the bottom of the well section for joining the two halves of the elevated rack 12 into a unitary construction. A tension member 98 in the form of a like chain is connected at one end 100 to the cross brace 94 while the other end 102 is joined to the rear end of the pivoted lever arm 86. One purpose of this tension member 98 is to support the pivoted lever arm 86 with its weighted disks 90 off of the floor from which this apparatus is supported. Moreover, the tension member 98 supports the pivoted lever 72 in a raised position off of the floor. However, there is a more important reason for the tension member 98 in that it cooperates with the pivoted lever arm 86 in providing a negative mechanical advantage as the pivoted elongated lever 72 is raised during power squat lifts as will be described in more detail in discussing FIG. 3.

Figure 5:
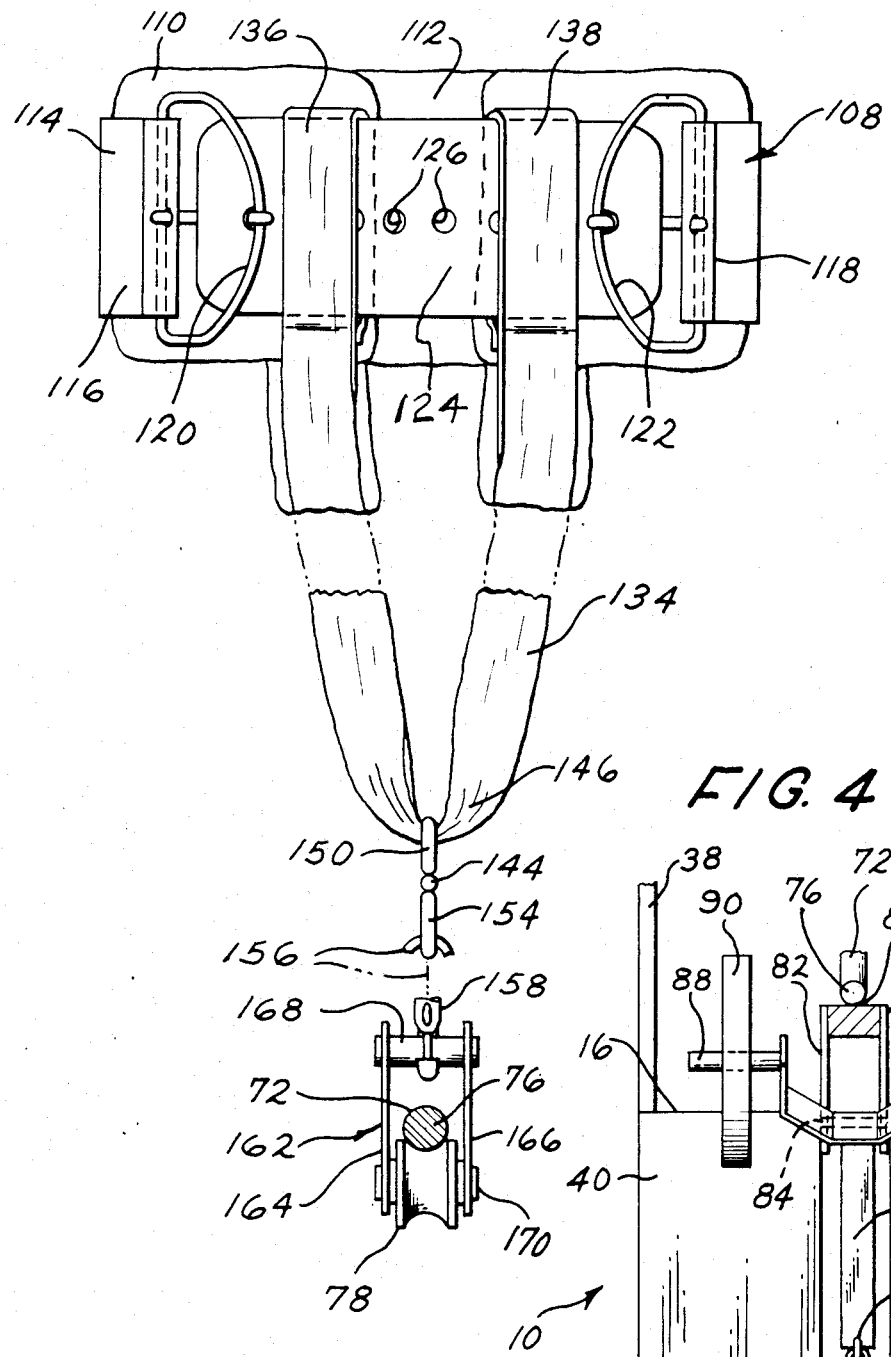
FIG. 5 is a front elevational view of the waist harness used in conjunction with the present invention having a heavily padded belt furnished with both front and rear straps suspended from the belt. The lower ends of the straps are joined by a connector that supports a tension member that carries a roller assembly for making engagement with the underside of the pivoted elongated lever of the weight lifting apparatus.

First it is necessary to understand the construction, nature and use of the waist harness 108 that is illustrated in FIG. 5 in a front elevational view. This waist harness is adapted to be fastened around the waist of a person planning to use the weight lifting apparatus 10 of the present invention for doing power squat lifts. This waist harness 108 has a thick fleece lining 110 which nearly encircles the person's waist except for a small opening 112 in the front. Attached to the outside of this fleece lining 110 is a shortened belt 114 which circumscribes about ⅔ of the average user's waist dimension, terminating near the front pelvic bone at each side as at 116 and 118. Notice that the thick fleece lining 110 is much higher than the height of the shortened belt 114 to ensure that both the top and bottom edges of the belt 114 are padded. The two ends 116 and 118 of this shortened belt 114 are each provided with a large buckle 120 and 122 respectively for cooperation and attachment with a plain strap 124 which is furnished with a plurality of longitudinally spaced holes 126 for engagement by the tongue 128 of each buckle 120 and 122 so that this plain strap 124 completes the encirclement of the user's waist by the shortened belt 114, and this strap 124 overlies the thick fleece lining 110 and bridges the gap formed by the opening 112.

There is a front, V-shaped strap 134 suspended from this plain strap 124. This is accomplished by providing a wide loop section 136 and 138 at the upper ends of each side of the V-shaped strap through which the plain strap 124 is threaded before the two ends of the strap 124 are buckled with the belt buckles 120 and 122. This front, V-shaped strap 134 is of such a length that it extends below the user's crotch with enough freedom so as not to cause discomfort.

Figure 3:
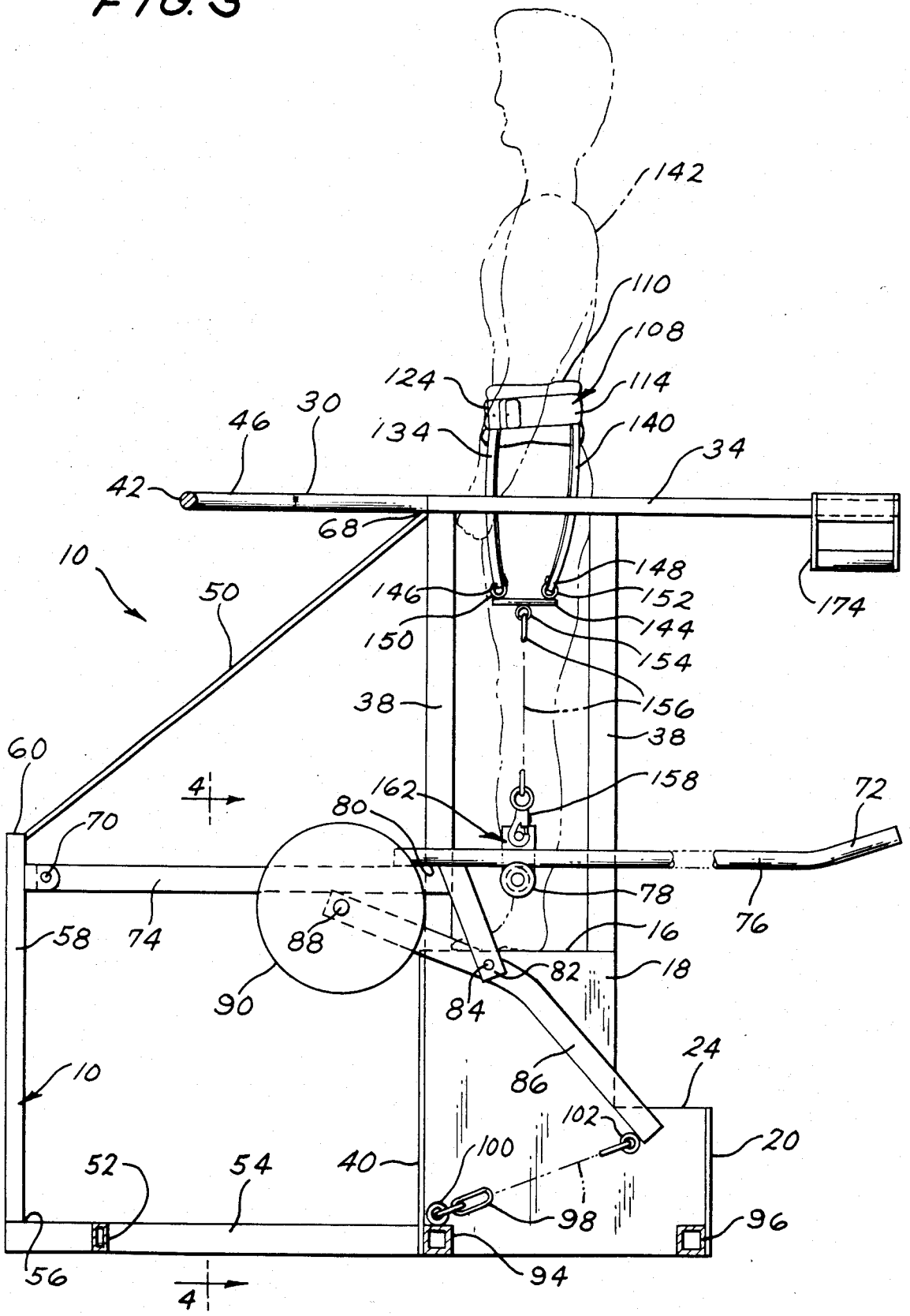
FIG. 3 is a cross-sectional side elevational view similar to that of FIG. 2 that is taken generally through the center of the apparatus, where the user is shown in phantom standing on the raised platform and wearing a waist harness that is furnished with both front and rear straps that are suspended from the belt down between the legs of the user. The lower ends of the straps are joined by a connector that supports a tension member that carries a roller assembly which slips onto the free end of the pivoted elongated lever and is located directly beneath the user so that the upward force exerted by this waist harness on the pivoted lever remains beneath the center of gravity of the user at all times.
Figure 4:
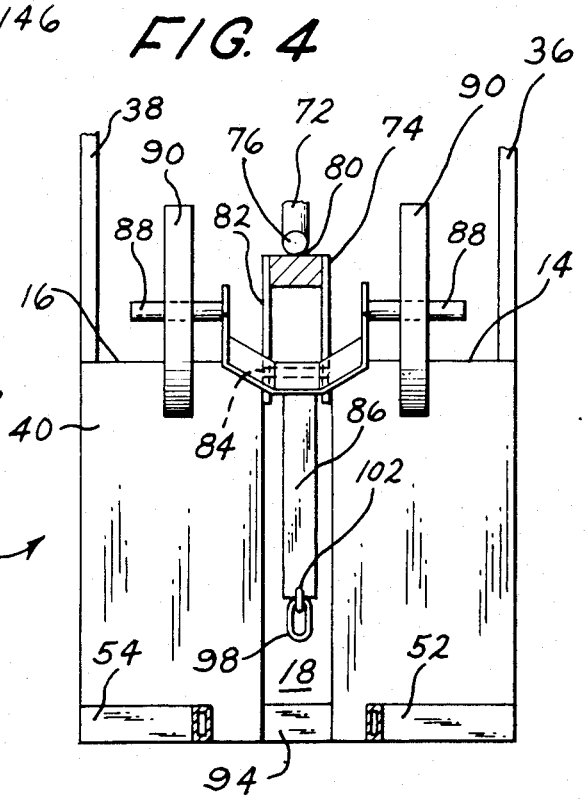
FIG. 4 is a fragmentary, cross-sectional elevational view of the lower portion of the elevated rack taken on the line 4—4 of FIG. 3 looking toward the rear of the apparatus.

There is also a rear, V-shaped strap 140, as shown diagrammatically in FIG. 3, and it has its two upper ends joined to the back side of the shortened belt 114 by any suitable means, such as being sewn in place or fastened to ring members (not shown) that are, in turn, strapped to the rear side of this shortened belt 114. Attention is drawn to the Applicant's co-pending patent application, Ser. No. 517,195, which was filed in the U.S. Patent and Trademark Office on July 26, 1983 and is entitled POWER SQUAT, WEIGHT LIFTING APPRATUS. This earlier co-pending patent application shows more of the details of construction of the Applicant's waist harness 108, and they are incorporated by reference herein.

Now, turning to the showing in FIG. 3, the user 142 is shown in phantom, and the waist harness 108 is fastened in place, having suspended from the shortened belt 114 the rear strap 140 and suspended from the plain strap 124 the front strap 134. An elongated connector member 144 joins the lower ends 146 and 148 of the front and rear straps 134 and 140 respectively. It must be remembered that this elongated connector member 144 is located between the user's legs. Since the user 142 is shown in phantom, the waist harness 108 is all shown in full lines as if the user weren't present at all. This elongated connector member 144 has a front ring member 150 that is integral with the top side of the connector, and it is for making engagement with the lower end 146 of the front strap 134. Similarly, there is a rear ring member 152 that is located on the top side of the connector and is integral therewith for making engagement with the lower end 148 of the rear strap 140. On the underside of the elongated connector member 144 is a third ring member 154 that is also integral with the connector and is positioned near the center of the connector. A link chain 156 is suspended at one end from this third ring member 154, and an adjustable clasp 158 is provided on the lower end of the chain. This link chain 156 is made to be adjustable in length to accommodate users of different heights and strength capabilities.

Turning to a consideration of the front elevational view of the waist harness 108 of FIG. 5, the link chain 156 is not shown suspended from the third ring member 154. In place of the chain is the adjustable clasp 158 that is connected directly to the third ring member 154. This is not the way the invention will be used. The illustration in FIG. 5 has the purpose of illustrating the features of construction of the waist harness 108, as well as the double flanged roller 78 that is mounted in a pulley block 162 that is suspended from the adjustable clasp 158. A link chain is a link chain, and it is felt that it need not be illustrated in FIG. 5 so as to be able to show the waist harness and the pulley block in as large a scale as possible. Looking at FIG. 3, it is obvious that if the pulley block 162 and its adjustable clasp 158 were joined directly to the third ring member 154 that the pivoted lever 72 would be at an angle of about 30 degrees, which is impossible in view of the presence of the chain 98 connected to the pivoted lever arm 86. In fact, the lever arm 72, in FIG. 3, cannot move up any further because the front end of the pivoted lever arm 86 is touching the lever 72.

Going back to FIG. 5, the pulley block 162 comprises a pair of parallel plates 164 and 166 which are spaced apart by an upper bolt 168 and a lower bolt 170 which happens to carry the double flanged roller 78. The rear portion 76 of the pivoted lever 72 extends through the pulley block 162, and the roller, or pulley, moves freely along the elongated length of the lever as the user mounts or dismounts the elevated rack.

Having described above the novel invention of a multi-lifting weight apparatus for use with power squat lifts, it will readily be apparent to those skilled in this art that the use of the present invention ensures correct squat form in that is discourages the previous tendency of the lifter, or user, to lean forward from the waist and to use his back and arm muscles for lifting the weights up after reaching the full squat position, thereby cheating because the legs were not doing all of the lifting. Previously, the back and arms were providing some of the lifting, and the legs did not receive the full benefit of the weights. Moreover, the use of the present invention eliminates back injuries since all of the weight is carried by the lower body. The use of the present invention concentrates the entire weight to be lifted in the large leg muscles, such as the front quadriceps and the back hamstring leg muscles. Finally, the center of gravity of the lifting force created by the roller 78 tends to shift as the user moves so as to be in direct line with the center of gravity of the user's body.

The major benefits from the power squat are from the hips down—the buttocks and legs. What takes place above the waist may be detrimental to the athlete. Ideally, the resistance to the weights should be placed on the hips, not the shoulders. If the resistance to the weights was placed on the shoulders, a balance problem is created that can eventually lead to shearing forces on the knee. Other problems include strain on the lower back muscles and compression of the spine. Since the lower back muscles are generally weaker than the combined strength of the buttocks and leg muscles, the lower back becomes susceptible to injury whenever the athlete exceeds the limits of the lower back muscles. The hips and legs never achieve full development because of the strength and structural limitations of the lower back.

Another advantage of the present invention is the incorporation of the handrail with the apparatus so that the user is holding on with his hand at all times to prevent losing his balance.

As seen in FIGS. 1–3, the handrail 30, at the rear of the apparatus, is furnished with adjustable handgrips 172 and 174 which are each provided with a socket portion 176 that has a bore 178 of generally square, transverse cross section so that this socket portion may slip onto the free end 180 of the side section 32 or 34. Notice, in FIG. 1, that the handgrip 174 is mounted vertically in its non-use position, while the handgrip 172 is turned through an angle of about 90 degrees so as to slip onto the end 180 of the handrail section 32. When both handgrips 172 and 174 are horizontally disposed on the handrailing, the lifter may engage the pulley block carrying the roller 78 with the pivoted lever 72, and, while standing on the floor, grasp the two handgrips 172 and 174 and raise and lower the elongated lever by use of the arms after the legs are raised so that all of the weight is carried by the arms. The lifter can either face forwardly of the elevated rack or may face with his back to the rear of the apparatus when using these adjustable handgrips 172 and 174.

An explanation of the negative mechanical advantage is that the more the user or lifter exerts a lifting force from start to the elongated lever 72 by way of the waist harness 108 carrying the chain 156 and roller 78, the more difficult the weights 90 are to lift. Work equals Weight moved through a Distance. The weights 90 move more distance than the lifting roller 78 moves because the weights are carried on the pivoted lever arm 86.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A weight lifting apparatus comprising:

a. a unitary elevated rack having a pair of raised platforms that are separated by a well section;

b. step means at one end of the rack serving as an entrance for mounting and dismounting the platforms;

c. a handrailing on at least three sides of the elevated rack on the sides other than the entrance side of the rack to serve as a balance means for the person using this apparatus;

d. the side of the rack that is opposite the entrance having a structural extension including a spaced supporting column with a raised, horizontally positioned, pivot means;

e. and an elongated lever having one end pivoted to said pivot means for movement in a generally vertical plane, and the elongated lever extending generally downward at an inclined angle from the pivot means through the well section of the elevated rack, the underside of the elongated lever supporting a pivoted lever arm carrying weights that are located within the structural extension and adjacent one of the free ends of the lever arm, and a flexible tension member connected at one end to the opposite free end of the pivoted lever arm and at its other end to a base portion of the said rack to provide the said pivoted elongated lever with a negative mechanical advantage as the elongated lever is being raised;

f. and a waist harness for use by a person standing on the elevated rack and straddling the said well section, said waist harness including a heavy belt with interior padding overlapping both the top edge and the bottom edge of the belt so as to protect the user from abrasion, and front and rear strap means suspended from the padded belt, and a connector member joining the lower ends of the strap means, and a tension member suspended from the connector member and having a roller means at its lower end for rolling engagement with at least the underside of the said pivoted elongated lever as the user is lifting the weights by means of the waist harness.

2. A waist harness for use by a person in a vertical standing position in lifting heavy weights that are adapted to be connected to a pivoted elongated lever that is located down between and below the user's feet when the person is doing power squats, said waist harness including a heavy belt with interior padding overlapping both the top edge and bottom edge of the belt so as to protect the user from abrasion, and front and rear strap means suspended from the padded belt, and a rigid, elongated connector member extending front to rear joining the lower ends of the front and rear strap means in the vicinity of the user's crotch, and a tension member suspended from the connector member down between the user's legs and having a roller means at its lower end, said roller means being adapted for rolling engagement with the underside of the said pivoted elongated lever as the user raises and lowers his body while in a standing position.

3. A weight lifting apparatus comprising:

a. a unitary elevated rack having a pair of raised platforms that are separated by a well section;

b. step means at one end of the rack serving as an entrance for mounting and dismounting the platforms;

c. the front side of the rack that is opposite the said entrance having a structural extension including a spaced supporting column with a raised, horizontally positioned, pivot means;

d. and an elongated lever having one end pivoted to said pivot means, and the elongated lever extending generally downwardly at an inclined angle from the pivot means through the well section, the underside of the elongated lever supporting a pivoted lever arm adjacent the midportion of the lever arm, one free end of the pivoted lever arm being provided with weights that are located within the said structural extension, and a flexible tension member connected at one end to the opposite free end of the pivoted lever arm and at its other end to a base portion of the said rack to provide the said elongated lever with a negative mechanical advantage as the elongated lever is raised so as to increase the resistance to the raising of the elongated lever and its weights that are carried thereby;

e. and a waist harness for use by a person standing on the elevated rack and straddling the said well section, said waist harness including a heavy belt with interior padding overlapping both the top edge and bottom edge of the belt so as to protect the user from abrasion, and front and rear strap means suspended from the padded belt down between the legs of the user, and a connector member joining the lower ends of the said strap means, and a tension member suspended from the connector member and having a roller means at its lower end for rolling engagement with the underside of the said elongated lever as the user is lifting the weights by raising and lowering his body.

4. A waist harness for use by a person in a vertical standing position in supporting heavy weights that are adapted to be connected to an elongated lever that pivots within a vertical plane when the person is doing power squats, said waist harness including a heavy belt with interior padding that extends above the top edge and below the bottom edge of the belt, and strap means suspended from the belt and adapted to extend between the legs of the user, said strap means including a V-shaped front strap suspended from the front of the belt, and a V-shaped rear strap suspended from the rear of the same belt, and rigid, elongated connector member extending front to rear joining the lower ends of both front and rear straps in the vicinity of the user's crotch, and a tension member suspended from the midportion of the said connector member down between the user's legs and having a roller means at its lower end adapted for rolling engagement with the underside of a weighted elongated pivoted lever as the user is performing power squats from a standing position.

* * * * *